US005129378A

United States Patent [19]

Donahue et al.

[11] Patent Number: 5,129,378

[45] Date of Patent: Jul. 14, 1992

[54] TWO-CYCLE MARINE ENGINE HAVING ALUMINUM-SILICON ALLOY BLOCK AND IRON PLATED PISTONS

[75] Inventors: Raymond J. Donahue, Fond du Lac; Richard A. Lanpheer, Oshkosh; W. Donald Schultz, Fond du Lac; Benjamin L. Sheaffer, Oshkosh, all of Wis.

[73] Assignee: Brunswick Corporation, Skokie, Ill.

[21] Appl. No.: 767,261

[22] Filed: Sep. 27, 1991

[51] Int. Cl.[5] ..... F02F 1/00; F02F 3/00

[52] U.S. Cl. ..... 123/193.4; 123/193.6; 123/193.2; 92/223; 29/888.04; 29/888.048; 29/888.06

[58] Field of Search ..... 123/193 CP, 193 C, 143 P; 92/223; 29/888.04, 888.048, 888.06

[56] References Cited

U.S. PATENT DOCUMENTS

| | | | |
|---|---|---|---|
| 3,896,009 | 7/1975 | Kobayashi et al. | 123/193 C |
| 3,935,797 | 2/1976 | Niimi et al. | 92/223 |
| 4,075,934 | 2/1978 | Wacker et al. | 92/223 |
| 4,603,665 | 8/1986 | Hesterberg et al. | 123/195 |
| 4,701,110 | 10/1987 | Iijima | 92/223 |
| 4,821,694 | 4/1989 | Hesterberg et al. | 123/195 |
| 4,966,220 | 10/1990 | Hesterberg | 164/34 |
| 4,969,428 | 11/1990 | Donahue et al. | 123/195 |

*Primary Examiner*—E. Rollins Cross
*Assistant Examiner*—M. Macy
*Attorney, Agent, or Firm*—Andrus, Sceales, Starke & Sawall

[57] ABSTRACT

A two-cycle, water-cooled marine engine having an engine block composed of a hypereutectic aluminum-silicon alloy. The silicon is distributed as discrete particles throughout the block, including the area bordering the walls of the cylinder bores. An aluminum piston is mounted for movement within each cylinder bore and the outer peripheral surface of each piston is plated with iron. With the iron plated piston in combination with the aluminum silicon alloy engine block, the engine is capable of being restarted after the engine seizes due to overheating caused by a blockage of the water cooling system.

12 Claims, No Drawings

TWO-CYCLE MARINE ENGINE HAVING ALUMINUM-SILICON ALLOY BLOCK AND IRON PLATED PISTONS

BACKGROUND OF THE INVENTION

It has long been recognized that the lighter weight and better heat transfer properties make aluminum alloys a logical choice as a material for internal combustion engine blocks. However, most aluminum alloys lack wear resistance and it has been customary in the past to chromium-plate the cylinder bores in the engine block, or alternately, to apply cast iron liners to the bores. It is difficult to uniformly plate the cylinder bores, and as a result, plating is an expensive operation, and in the case of chromium plating, not environmentally friendly. The use of cast iron liners increases weight of the engine.

It is also recognized that there is a difference in the need for wear resistance between a four-cycle engine and a two-cycle engine. It has been found that there is a wear step in a four cycle cylinder bore area which is not seen in the two-cycle engine, and this wear step occurs where the piston and ring assembly changes direction from moving upward in the bore to downward in the bore. This fundamental difference occurs because the two cycle engine uses a charge of fuel and oil and thus lubricates the ring reversal area. Because of the less demanding wear requirements of a two-cycle engine, the bores of the two-cycle engine are frequently not honed and etched.

Hypereutectic aluminum-silicon alloys containing 17% to 19% by-weight of silicon possess good wear resistance achieved by the precipitated silicon crystals, which constitute the primary phase. Because of the wear resistance, attempts have been made to utilize hypereutectic aluminum silicon alloys as casting alloys for engine blocks to eliminate the need of plated or lined cylinder bores. However, the typical aluminum silicon alloy contains a substantial concentration of copper and when these alloys are used in humid or salt water environments, corrosion of the alloy can occur, with the result that alloys of this type are not acceptable as engine blocks for marine engines.

U.S. Pat. No. 4,603,665, describes a hypereutectic aluminum-silicon casting alloy having particular use in casting engine blocks for marine engines. The alloy of that patent is composed by weight of 16% to 19% silicon, 0.4% to 0.7% magnesium, less than 0.37% copper and the balance aluminum. This alloy has a narrow solidification range providing the alloy with excellent castability, and as the copper content is maintained at a minimum, the alloy has improved resistance to salt water corrosion.

U.S. Pat. No. 4,969,428 is directed to a hypereutectic aluminum-silicon alloy containing in excess of 20% by weight of silicon and having an improved distribution of primary silicon in the microstructure. The alloy of this patent contains from 20% o 30% by weight of silicon, 0.5% to 1.3% magnesium, up to 1.4% iron, up to 0.3% manganese, less than 0.35% copper and the balance aluminum. Due to the high silicon content in the alloy of U.S. Pat. No. 4,969,428, along with the uniform distribution of the primary silicon in the microstructure, improved wear resistance is achieved, making the alloy particularly suitable for use as an engine block for a marine engine.

DESCRIPTION OF THE PREFERRED EMBODIMENT

The invention is directed to a two-cycle, water-cooled marine engine having an engine block composed of a hypereutectic aluminum-silicon alloy and having a plurality of unplated and unlined cylinder bores containing iron plated aluminum pistons. The combination of the hypereutectic aluminum silicon block, along with the iron plated pistons enables the engine to be restarted after the engine seizes, due to overheating by virtue of a blockage in the water cooling system.

The marine engine is a conventional two-cycle engine containing a plurality of cylinder bores, each of which receives a piston. The engine is cooled by a water cooling system, in which water is drawn in through a water intake from an external body of water and is circulated through a water cooling system in the engine block. The overheating problem with the two-cycle engine by virtue of a blockage in its water source for cooling, which comes through its inlet water pick-up, vents from an external source, does not occur in the four-cycle engine designs of the automotive industry because automotive four-cycle engines have their own recirculating, self-contained water cooling system. Thus, the problem is unique to two-cycle engines in a marine environement.

The engine block is composed of a hypereutectic aluminum-silicon alloy containing more than 12% silicon. The precipitate primary silicon particles or crystals are distributed throughout the block, including the portion of the block bordering the cylinder bores, and provide improved wear resistance for the block.

In general, the aluminum silicon alloy contains by weight from 12% to 30% silicon 0.4% to 1,0% magnesium, less than 1.45% iron, less than 0.3% manganese, less than 0.37% copper, and the balance aluminum.

More particularly, the engine block can be composed of an aluminum-silicon alloy as described in U.S. Pat. No. 4,969,428, having the following composition in weight percent:

| | |
|---|---|
| Silicon | 20.0%-30.0% |
| Magnesium | 0.4%-1.6% |
| Iron | Less than 1.45% |
| Manganese | Less than 0.30% |
| Copper | Less than 0.25% |
| Aluminum | Balance |

Alternately, the engine block can be composed of a hypereutectic aluminum-silicon alloy, as described in U.S. Pat. No. 4,821,694, having the following composition in weight percent:

| | |
|---|---|
| Silicon | 16.0%-19.0% |
| Magnesium | 0.4%-0.7% |
| Iron | Less than 1.4% |
| Manganese | Less than 0.3% |
| Copper | Less than 0.37% |
| Aluminum | Balance |

The silicon, being present as discrete precipitated particles or crystals, contributes to the wear resistance of the alloy.

The magnesium acts to strengthen the alloy through age hardening, while the iron and manganese tend to harden the alloy, decrease its ductility, increase its machinability, and aid in maintaining the mechanical properties of the alloy at elevated temperatures.

By minimizing the copper content, the corrosion resistance of the alloy to salt water environments is greatly improved.

The alloy can also contain small amounts up to about 0.2% each of residual hardening elements, such as nickel, chromium, zinc or titanium.

Due to the increased wear resistance brought about by the silicon crystals or particles, it is not necessary to plate or provide cast iron liners for the cylinder bores.

Aluminum pistons are normally used in marine two-cycle engines, and in the development of the invention, it has been found that a problem could arise when using chromium plated aluminum pistons, with the aluminum silicon alloy engine block in the event the engine seized due to overheating. More particularly, small two-cycle engines, such as 25 HP outboard engines, are used for fishing and frequently operate in shallow water. During such operation, it is possible that the water intake to the cooling system of the engine may be clogged by lily pads, weeds, or the like, with the result that the flow of cooling water to the engine is decreased or terminated causing the engine to overheat and eventually seize. After cooling down, it has been found that an engine using chromium plated pistons in combination with an aluminum silicon alloy engine block cannot be restarted, and in certain cases, the engine may be permanently damaged. This problem, i.e. the inability to restart the engine after overheating, does not occur in prior type engines using chromium plated cylinder bores, or cylinder bores containing cast iron liners.

The invention is based on the discovery that the use of iron plated aluminum pistons with an aluminum silicon alloy engine block will overcome this problem and enable the engine to be restarted after overheating. This result is unexpected.

In accordance with the invention, the outer peripheral surface of the piston is plated with iron to a thickness in the range of about 0.003 to 0.006 inch. For corrosion resistance, a flash coating of tin can be applied over the iron plating, with the tin generally having a thickness less than 0.001 inch. It is believed that the flash coating of tin has no function in the ability of the engine to be restarted after overheating.

To show the unexpected results achieved by the use of the iron plated pistons, a series of tests were conducted using identical power heads from a Mercury 25 HP two-cycle outboard engine. The power heads were composed of an aluminum-silicon alloy containing 20.5% silicon, 0.7% magnesium, 0.2% manganese, 0.8% iron, 0.15% copper, and the balance aluminum. The cylinder bores of the engine blocks were unplated.

In three tests, chromium plated aluminum pistons were utilized with the chromium plating having a thickness of 0.0006 inch, while in a fourth test an iron plated piston was utilized, with the iron plating having a thickness of 0.0005 inch. The pistons in each case included a chromium-plated top piston ring and a lower piston ring of cast iron.

In all tests, the engine was run with cooling water for a period of five minutes to stabilize the operation. The water flow was then turned off and the engine allowed to run until it seized due to overheating. After cooling down for a period of approximately 5 to 10 minutes, an attempt was made to restart the engine. In addition, the condition of the cylinder bores of each engine was inspected to determine whether damage had occurred by the seizure.

The results of the tests are as follows:

| Test No. | Engine Operating Speed | Time Before Seizure (Mins) | Restart | Condition Of Cylinder Bores |
|---|---|---|---|---|
| 1. | 4500 rpm | 2.1 | No | Severe scoring |
| 2. | 4500 rpm | 1.8 | No | Severe scoring |
| 3. | 4500 rpm | 7.6 | No | Severe scoring |
| 4. | 4500 rpm | 3.0 | Yes | No scoring |

In Test Nos. 1-3, using chromium plated pistons, the engines could not be restarted after seizure and the cylinder bores showed severe scoring. In contrast, the engine using iron plated pistons, Test No. 4, was able to be restarted, and the cylinder bores showed no evidence of scoring. The above tests show the unexpected results achieved by the use of iron plated aluminum pistons in combination with a hypereutectic aluminum-silicon alloy engine block in a two-cycle water cooled marine engine. For some unexpected reason, not fully understood, the use of iron plating on the pistons in place of chromium will enable the engine to be restarted after overheating without permanent damage to the engine. This result is totally unexpected and unobvious, due to the fact that both the chromium and iron plating coatings would normally be expected to produce the same results.

Various modes of carrying out the invention are contemplated as being within the scope of the following claims particularly pointing out and distinctly claiming the subject matter which is regarded as the invention.

We claim:

1. In a two-cycle water cooled internal combustion marine engine, an engine block defining at least one cylinder bore and composed of a hypereutectic aluminum-silicon alloy containing more than 12% silicon and containing primary silicon particles substantially uniformly distributed throughout said block including the area bordering said bores, a piston slidable within the bore and having an outer cylindrical surface, said outer surface composed of iron.

2. The engine of claim 1, wherein said outer surface comprises a plated coating of iron having a thickness in the range of 0.0003 to 0.0006 inch.

3. The engine of claim 2, and including a film of tin on said coating of iron with said film of tin having a thickness less than 0.0001 inch.

4. The engine of claim 2, wherein said piston is composed of aluminum.

5. The engine of claim 1, wherein said alloy has the following composition in weight percent:

| | |
|---|---|
| Silicon | 20.0%-30.0% |
| Magnesium | 0.4%-1.6% |
| Copper | Less than 0.25% |
| Iron | Less than 1.45% |
| Manganese | Less than 0.30% |
| Aluminum | Balance |

6. The engine of claim 1, wherein said alloy has the following composition in weight percent:

| | |
|---|---|
| Silicon | 16.0%-19.0% |
| Magnesium | 0.4%-0.7% |
| Copper | Less than 0.37% |

-continued

| | |
|---|---|
| Iron | Less than 1.40% |
| Manganese | Less than 0.30% |
| Aluminum | Balance. |

7. In combination, an engine block for a two-cycle water cooled marine engine and defining a plurality of cylinder bores, said block composed of a hypereutectic aluminum-silicon alloy having more than 12% silicon and containing primary silicon particles substantially uniformly distributed throughout said block including the area bordering said bores, said engine block having a water cooling system including a water intake through which water is drawn into the system from an external body of water, an aluminum piston slidable within each of said cylinder bores, and a layer of iron disposed on the outer peripheral surface of each piston, said engine being characterized by the ability to be restarted after seizure due to overheating by a blockage of said water intake.

8. The engine of claim 7, wherein said aluminum silicon alloy contains by weight from 20.% to 30.0% silicon, 0.4% to 1.6% magnesium, less than 1.45% iron, less than 0.30% magnesium, less than 0.25% copper, and the balance aluminum.

9. The combination of claim 7, wherein said alloy contains by weight from 16.0% to 19.0% silicon, 0.4% to 0.7% magnesium, less than 1.4% iron, less than 0.30% manganese, less than 0.37% copper, and the balance aluminum.

10. The combination of claim 7, wherein said layer of iron has a thickness in the range of 0.0003 to 0.0006 inch.

11. The combination of claim 7, and including a film of tin on the outer surface of said layer of iron.

12. The combination of claim 7, wherein the iron coating extends continuously between opposed ends of each piston.

* * * * *